United States Patent [19]

Burn

[11] 4,005,494

[45] Feb. 1, 1977

[54] POCKET SOCK AND METHOD OF KNITTING SAME

[75] Inventor: William H. Burn, Niota, Tenn.

[73] Assignee: The Pocket Socks Corporation, Ten Mile, Tenn.

[22] Filed: Oct. 20, 1975

[21] Appl. No.: 623,982

[52] U.S. Cl. ..... 2/239; 66/173

[51] Int. Cl.[2] ..... A41B 11/00

[58] Field of Search ..... 2/239, 240, 224 R; 66/173, 172 R, 171, 170, 176, 177, 178 R

[56] References Cited

UNITED STATES PATENTS

| | | | |
|---|---|---|---|
| 767,381 | 8/1904 | Brown | 2/239 |
| 1,045,620 | 11/1912 | Scott | 66/173 |
| 1,072,640 | 9/1913 | Nydegger | 66/171 |
| 1,206,171 | 11/1916 | Thierfelder | 66/173 |
| 3,757,354 | 9/1973 | Moody | 2/224 R |
| 3,909,851 | 10/1975 | Garrou et al. | 2/224 R |

*Primary Examiner*—H. Hampton Hunter
*Attorney, Agent, or Firm*—Bell, Seltzer, Park & Gibson

[57] ABSTRACT

The present sock includes a pocket which is integrally knit with the leg portion of the sock. The pocket may be positioned down inside of the leg or it may be positioned on the outside of the leg and may be used to hold various articles or it may be used for decorative effects. The pocket is formed of first and second layers of knit fabric formed of partial courses which are all the same length with the upper ends of each layer being integrally knit with the leg portion to provide a looped fabric section with open sides. After knitting of the sock is completed, the looped open sides of the pocket are stitched together to complete the pocket.

9 Claims, 5 Drawing Figures

POCKET SOCK AND METHOD OF KNITTING SAME

This invention relates generally to a sock with an integrally knit pocket in the leg portion thereof and more particularly to such a sock and to the method of forming the same wherein the pocket includes first and second layers of knit fabric formed of partial courses of equal length to provide a looped fabric section integrally knit with the leg portion. The open sides of the looped layers of knit fabric are stitched together after completion of the knitting of the sock to form the pocket therefrom.

It is generally known to provide various types of pockets in hosiery articles and the pockets are usually formed in a separate cut-and-sew operation and then attached to various portions of the socks. The production of this type of pocket sock requires several operations which increase the cost of manufacture of such socks. Socks with double cuffs have also been provided to carry various types of articles in the double cuff. However, articles carried in socks with double cuffs may easily become dislodged and lost since no provision is made for retaining the articles in the double cuff.

With the foregoing in mind, it is an object of the present invention to provide a pocket sock and method of knitting the same whereby the pocket is integrally knit with the sock so that it is formed in an economical manner and wherein the pocket can be used to conceal and securely hold the articles carried therein.

In accordance with the present invention, the pocket has an opening extending partially around the leg portion of the sock and below the cuff of the sock. The pocket extends downwardly along the leg portion from the opening and includes first and second layers of knit fabric formed of partial courses of equal length. The upper ends of the first and second layers of knit fabric are integrally knit with the leg portion and the lower end of the first and second layers of the pocket are integrally knit and joined along a fold line extending across the lower end of the pocket. A line of stitching extends up opposite sides of the pocket and joins opposite sides of the first and second layers to each other to close opposite sides of the pocket. The partial courses forming the first and second layers of the pocket encompass substantially half of the wales in the leg of the sock and the length of the first and second layers of the pocket is substantially the same as the width of the pocket.

The pocket sock may be knit on any one of several well-known types of circular hosiery knitting machines and requires only minor changes in the conventional operation of the machines. The pocket is integrally formed during the knitting of the leg portion of the sock with only the stitching together of the opposite sides of the pocket being necessary after completion of the knitting of the sock. The pocket may be folded down inside of the leg of the sock or it may remain on the outside of the leg of the sock and the pocket may be used to carry various types of articles or it may be used for decorative effects Other objects and advantages will appear as the description proceeds when taken in connection with the accompanying drawings, in which FIG. 1 is a perspective view of the pocket sock with the pocket being folded inside of the leg portion and supporting an article therein, illustrated as a package of cigarettes;

Figure 1:
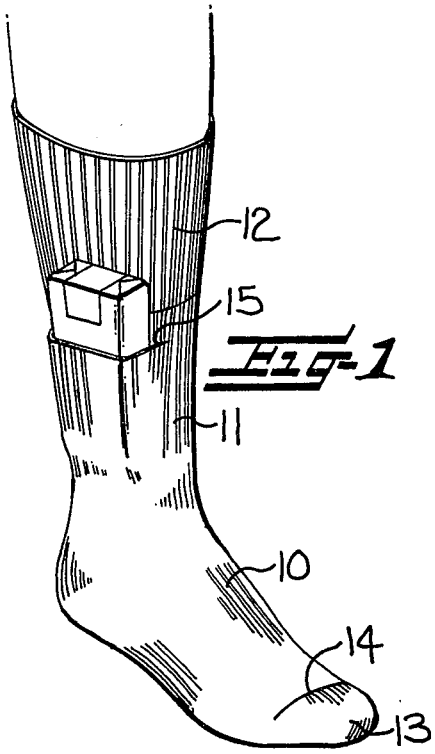

As illustrated in FIG. 1, the sock includes integrally knit respective foot, leg and cuff portions 10, 11 and 12 and with the leg portion 11 being knit throughout at least the major portions thereof of complete courses. The sock illustrated in the drawings is of the "tube" type with the foot portion 10 and the leg portion 11 being continuously knit with complete courses so that this sock does not contain the usual type of reciprocatorily knit heel pocket. However, it is to be understood that a reciprocatorily knit heel pocket may be provided, if desired. The foot portion 10 includes a toe portion 13 which may be formed in any suitable manner and the usual toe opening is closed by a line of stitching 14. The lines on the sock indicate the direction the wales extend and the courses extend perpendicular thereto.

Figure 4:
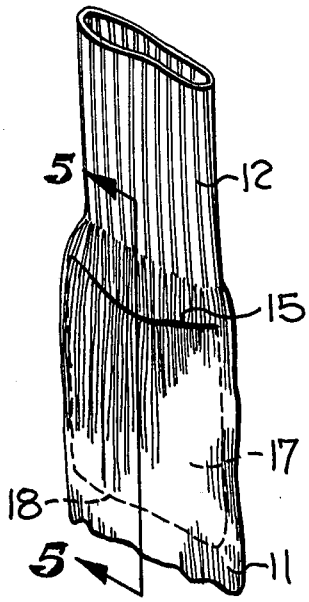
FIG. 4 is an isometric view of the upper end of the sock with the pocket positioned down inside of the leg of the sock.
Figure 5:
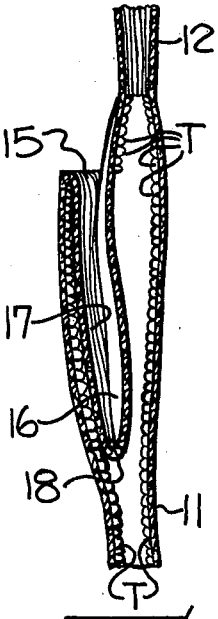
FIG. 5 is a somewhat enlarged fragmentary vertical sectional view through the pocket, being taken substantially along the line 5—5 in FIG. 4.

The pocket includes an opening 15 extending partially around the leg portion 11 and spaced below the cuff 12. As shown in FIGS. 1, 4 and 5, the pocket extends downwardly inside of the leg portion 11 from the opening 15 and includes a first or inner layer of knit fabric 16 and a second or outer layer of knit fabric 17. Both the first and second layers 16, 17 of knit fabric are formed of partial courses of equal length and the upper upper ends of the first and second layers 16, 17 are integrally knit with the leg portion 11. The lower ends of the first and second layers 16, 17 are integrally knit and joined along a fold line (FIG. 5) extending across the lower end of the pocket. Stitching means, illustrated as lines of stitching 20, 21 in FIG. 3, extend up opposite sides of the pocket and join together the normally open opposite sides of the first and second layers 16, 17.

As illustrated in the drawings, the partial courses of equal length forming the first and second layers of fabric 16, 17 encompass substantially half the wales of the leg portion 11 of the sock and the length of the first and second layers 16, 17 is substantially the same as the width of the pocket. However, it is to be understood that these dimensions may be varied as desired to provide a larger or smaller pocket.

Figure 3:
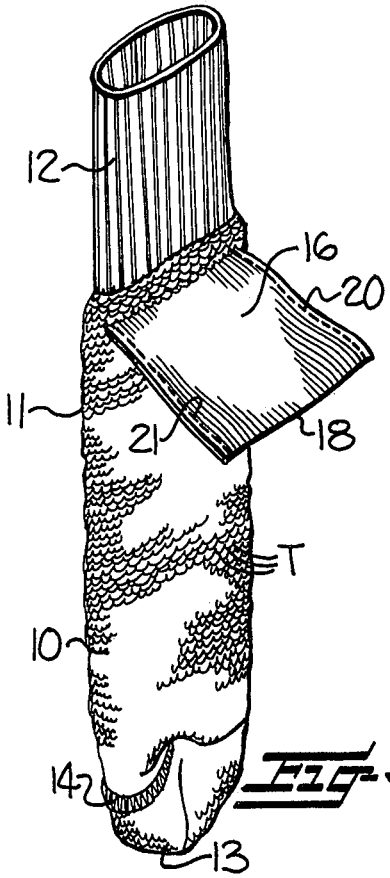
FIG. 3 is a view similar to FIG. 2 but showing the sock in everted condition and with the normally open opposite edges of the first and second layers of the pocket being stitched together along opposite sides thereof.

As best illustrated in FIG. 3, the inner surface of the leg and foot portion 10, 11 of the sock is provided with inwardly extending terry loops, indicated at T, while the first and second layers 16, 17 of the pocket are devoid of terry loops. The pocket may also be positioned at any desired location around the leg portion 11 and may be spaced closer to or further away from the cuff 12. In certain instances, it may be desirable to knit the partial courses forming the first and second layers 16, 17 of a different colored yarn from the yarn used in forming the leg 11 and the pocket can be positioned outside of the leg to provide various decorative effects to the sock. When the pocket is positioned inside of the leg, as illustrated in FIGS. 1 and 4, the articles carried therein may be concealed and/or maintained in the pocket by turning the upper end of the cuff portion 12 downwardly thereover. Also, when the pocket is positioned on the outside of the leg, access to the pocket may be obtained by stretching the cuff portion 12 outwardly from the leg of the wearer.

METHOD OF KNITTING

As a specific but non-limiting example, the method of knitting the present sock will be described as it is knit on a particular type of circular knitting machine. However, it is to be understood that the present sock may be knit on other types of knitting machines.

The sock is knit on a 108 needle circular hoisery knitting machine and is knit from the upper edge of the cuff 12 to the toe opening closure 14. At the upper end of the cuff 12, the usual make-up is formed by inlaying elastic yarn on alternate needles for several rotations of the needle cylinder and then a mock-rib fabric is knit to form the cuff 12 by feeding the elastic yarn to every fourth needle while floating the elastic yarn inside of the three intermediate needles to inlay the elastic yarn in a well-known manner. After knitting the desired length of cuff 12, the inlaying of the elastic yarn is discontinued and rotation of the needle cylinder is continued while feeding both a body yarn and a terry loop yarn to all of the needles to form plain jersey stitches on all of the needles with the body yarn and to form inwardly extending terry loops in the complete courses of the upper portion of the leg 11, before forming the pocket. It is preferred that the pocket may be formed after knitting approximately 24 complete courses below the cuff 12.

The pocket is then formed by switching the drive of the needle cylinder so that the needle cylinder reciprocates and substantially half of the needles (54 needles) are raised to an inactive or non-knitting position while the remaining 54 needles knit with each swing of the needle cylinder. Successive partial courses, all of the same length, are knit with each swing of the needle cylinder to form the first and second layers 16, 17 (FIG. 2) with the open opposite sides. After the desired number of partial courses are knit with reciprocation of the needle cylinder, and while feeding only the body yarn to all of the needles, without forming terry loops, the drive of the machine is again switched to continuously rotate the needle cylinder and the 54 needles which have remained in the idle or non-knitting position during formation of the inner and outer layers 16, 17 of the pocket are again lowered to active or knitting position to again form complete courses.

Figure 2:
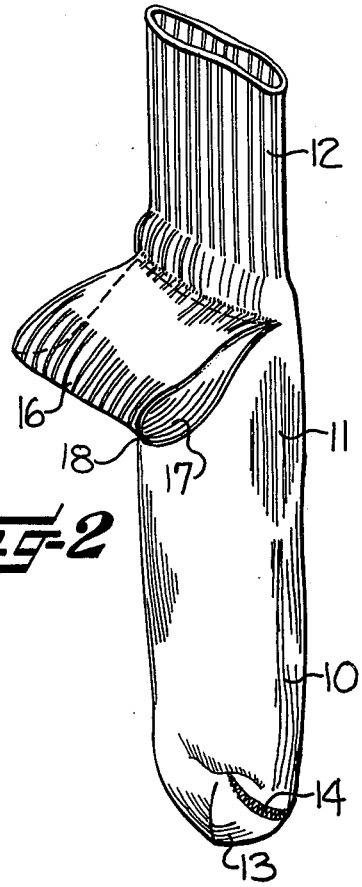
FIG. 2 is an isometric view of the pocket sock in flattened condition and as it appears when the knitting is completed, with the toe opening closed.

With the formation of the first complete course below the pocket, the corresponding portion of the last complete course of the group complete courses above the pocket is joined to the first complete course of the second group of complete courses below the pocket to provide a looped section of the partial courses, as illustrated in FIG. 2. With continued rotation of the needle cylinder, the remaining portion of the leg 11 and the foot 10 are knit with inwardly extending terry loops and the toe portion 13 is then formed in any desired manner.

When the knitting of the sock blank is completed, the toe end of the sock is open and the opposite sides of the looped fabric formed by the first and second layers 16, 17 are unconnected. The pocket is then completed by sewing opposite side edges of the layers 16, 17 together, as illustrated by the dotted seam lines 20, 21 in FIG. 3. The seam lines 20, 21 are preferably formed with at least the cuff 12 and the upper end of the leg portion 11 in everted condition, as illustrated in FIG. 3, so that the seamed edges are positioned inside of the leg of the sock and outside of the pocket when the pocket is positioned down inside of the leg 11, as illustrated in FIG. 4. The toe opening may be closed by the seam line 14 either before of after the opposite sides of the pocket are seamed.

In the drawings and specifications, there has been set forth a preferred embodiment of the invention, and although specific terms are employed, they are used in a generic and descriptive sense only and not for purposes of limitation, the scope of the invention being defined in the claims.

That which is claimed is:

1. A sock including integrally and circularly knit foot, leg and cuff portions with said leg portion being knit throughout at least the major portion thereof of complete seamless courses of body yarn, said cuff portion including elastic yarn incorporated with the body yarn to contract said cuff portion and to aid in supporting said cuff portion on the leg of the wearer, and a pocket having an opening positioned below said cuff portion extending partially around said leg portion, the positioning of said opening below said cuff portion being no greater than the length of said cuff portion so that said cuff portion may be turned down to cover said pocket opening for concealing and maintaining articles in said pocket, said pocket extending downwardly along said leg portion from said opening and comprising first and second layers of knit fabric formed of partial courses, said first and second layers of said pocket each including an upper end integrally knit with said leg portion, the lower ends of said first and second layers of said pocket being integrally knit and joined along a fold line extending across the lower end of said pocket, and stitching means extending along opposite sides of said pocket and joining said first and second layers to each other.

2. In a sock according to claim 1 wherein said partial courses forming said first and second layers of said pocket encompass substantially half of the wales in said leg portion of said sock.

3. In a sock according to claim 2 wherein the length of said first and second layers of said pocket is substantially the same as the width of said pocket.

4. In a sock according to claim 1 including terry loops extending inwardly of said leg portion of said sock, and wherein said first and second layers of said pocket are devoid of terry loops.

5. A method of forming a knitted sock including a pocket integrally formed in the leg portion thereof, said method comprising the steps of circularly knitting a first group of complete seamless courses for a predetermined length, knitting a plurality of partial courses all of the same length, knitting a second group of complete seamless courses while joining together corresponding portions of the last complete course of said first group of complete courses and the first complete course of said second group of complete courses to thereby form a looped section of said partial courses, continuing to knit to form the remaining leg and foot portions of said sock, sewing opposite side edges of said looped section together to form a pocket with inner and outer layers joined at their corresponding ends along a fold line and with the other ends of said inner and outer layers integrally joined to the last complete course of said first group of complete courses and to the first complete course of said second group of complete courses.

6. A method according to claim 5 which includes the step of knitting complete courses and forming a cuff prior to knitting said first group of complete courses, and then everting at least said cuff and the upper end of said leg portion before sewing the opposite side edges of said looped section together so that the sewn edges are positioned inside of said leg of said sock and outside of said pocket.

7. A method according to claim 5 including the step of forming terry loops on the inner surface of the complete courses of said leg portion surrounding said pocket.

8. A method according to claim 5 including the step of knitting complete courses to form said foot portion.

9. A method of forming a knitted sock including a pocket integrally formed in the leg portion thereof, said method comprising the steps of circularly knitting a first group of complete seamless courses of body yarn while incorporating elastic yarn in said first group of complete courses to form a cuff portion for supporting the sock on the leg of the wearer, knitting a second group of complete seamless courses of the body yarn for a predetermined length, knitting a plurality of partial courses all of the same length, knitting a third group of complete seamless courses while joining together corresponding portions of the last complete course of said second group of complete courses and the first complete course of said third group of complete courses and to form a looped section of said partial courses, continuing to knit to form the remaining leg and foot portions of said sock, sewing opposite side edges of said looped section together to form a pocket with inner and outer layers joined at their corresponding ends along a fold line and with the respective other ends of said inner and outer layers being integrally joined to the last complete course of said second group of complete courses and to the first complete course of said third group of complete courses and to provide a pocket opening at the juncture of said second and third groups of complete courses with the pocket opening being positioned below said cuff portion such that the cuff portion may be turned down to cover the pocket opening for concealing and maintaining articles in the pocket.

* * * * *

UNITED STATES PATENT OFFICE

CERTIFICATE OF CORRECTION

PATENT NO. : 4,005,494

DATED : February 1, 1977

INVENTOR(S) : William H. Burn

It is certified that error appears in the above-identified patent and that said Letters Patent are hereby corrected as shown below:

Column 2, line 38, delete "upper";
Column 3, line 55, after "group", insert -- of --;
Column 4, line 9, change the first occurrence of "of" to -- or --;
line 11, change "specifications" to -- specification --;

IN THE CLAIMS:

Column 4, line 26, before "extending", insert -- and --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*